US009355560B2

(12) United States Patent
Stenneth et al.

(10) Patent No.: US 9,355,560 B2
(45) Date of Patent: May 31, 2016

(54) DIFFERENTIATION OF PROBE REPORTS BASED ON QUALITY

(71) Applicant: HERE Global B.V., Veldhoven (NL)

(72) Inventors: Leon Oliver Stenneth, Chicago, IL (US); Gavril Adrian Giurgiu, Chicago, IL (US)

(73) Assignee: HERE Global B.V., Veldhoven (NL)

( * ) Notice: Subject to any disclaimer, the term of this patent is extended or adjusted under 35 U.S.C. 154(b) by 91 days.

(21) Appl. No.: 14/169,451

(22) Filed: Jan. 31, 2014

(65) Prior Publication Data

US 2015/0221216 A1 Aug. 6, 2015

(51) Int. Cl.
*G08G 1/01* (2006.01)

(52) U.S. Cl.
CPC ..... *G08G 1/0112* (2013.01); *G08G 1/0133* (2013.01); *G08G 1/0141* (2013.01)

(58) Field of Classification Search
CPC ..... G08G 1/00; G08G 1/0104; G08G 1/0108; G08G 1/0112; G08G 1/0125; G08G 1/129; G08G 1/0133; G08G 1/0137; G08G 1/0141; G08G 1/0145; G08G 1/096716
USPC ..... 701/23–28, 117–124, 422–426, 701/450–453, 482, 300; 340/988, 989
See application file for complete search history.

(56) References Cited

U.S. PATENT DOCUMENTS

| | | | | |
|---|---|---|---|---|
| 5,539,645 | A * | 7/1996 | Mandhyan et al. | 701/119 |
| 6,317,686 | B1 * | 11/2001 | Ran | 701/533 |
| 6,466,862 | B1 * | 10/2002 | DeKock et al. | 701/117 |
| 7,912,629 | B2 * | 3/2011 | Sutter et al. | 701/118 |
| 8,364,391 | B2 * | 1/2013 | Nagase | G01C 21/32 340/991 |
| 8,396,659 | B2 * | 3/2013 | Ando | G01S 19/49 701/446 |
| 8,762,036 | B2 * | 6/2014 | Nikovski | 701/117 |
| 8,918,278 | B2 * | 12/2014 | Feldman et al. | 701/410 |
| 8,972,192 | B2 * | 3/2015 | Bespalov et al. | 702/2 |
| 9,053,631 | B2 * | 6/2015 | Skupin | G08G 1/0112 |
| 9,121,718 | B2 * | 9/2015 | Uyeki | G01C 21/32 |
| 2002/0082767 | A1 * | 6/2002 | Mintz | 701/117 |

(Continued)

FOREIGN PATENT DOCUMENTS

| | | |
|---|---|---|
| EP | 1918895 | 5/2008 |
| WO | WO2009026161 | 2/2009 |
| WO | WO2011162966 | 12/2011 |

OTHER PUBLICATIONS

Leon Stenneth et al. "Transportation Mode Detection using Mobile Phones and GIS Information," presented at the 19th ACM SIGSPATIAL International Conference on Advances in Geographic Information Systems (ACM SIGSPATIAL GIS 2011), Nov. 1-4, 2011 (Chicago, Illinois), pp. 54-63.

*Primary Examiner* — Thomas Tarcza
*Assistant Examiner* — Tyler J Lee
(74) *Attorney, Agent, or Firm* — Lempia Summerfield Katz LLC

(57) ABSTRACT

Methods for differentiating high quality probe reports in a plurality of probe reports include: (a) receiving, by a processor, a probe report from a probe source, wherein the probe report includes data indicative of a travel condition; (b) determining, by the processor, whether the probe report satisfies a criterion indicative of high quality data; and (c) identifying, by the processor, the probe report as being (i) suitable for use in modeling the travel condition if the probe report satisfies the criterion, or (ii) unsuitable for use in modeling the travel condition if the probe report does not satisfy the criterion. Systems for differentiating high quality probe reports in a plurality of probe reports are described.

19 Claims, 6 Drawing Sheets

(56) References Cited

U.S. PATENT DOCUMENTS

2007/0208492 A1* 9/2007 Downs ..... G08G 1/0104 701/117
2008/0004804 A1* 1/2008 Fujita ..... G01C 21/30 701/446
2008/0077315 A1* 3/2008 Yao ..... 701/117
2008/0091339 A1* 4/2008 Nagase ..... G01C 21/32 701/532
2008/0270013 A1* 10/2008 Ishikawa ..... G01C 21/28 701/117
2009/0080973 A1 3/2009 Bespalov et al.
2009/0153364 A1 6/2009 Buchalo et al.
2010/0217522 A1* 8/2010 Ando ..... G01S 19/49 701/532
2011/0160986 A1* 6/2011 Wu et al. ..... 701/117
2011/0160987 A1* 6/2011 Wu et al. ..... 701/117
2013/0131974 A1* 5/2013 Uyeki ..... G01C 21/32 701/410
2014/0136453 A1* 5/2014 Morimura ..... G01N 99/005 706/12
2014/0244164 A1* 8/2014 Gale et al. ..... 701/446
2014/0316686 A1* 10/2014 Skupin ..... G08G 1/0112 701/117
2015/0253141 A1* 9/2015 Kesting ..... G01C 21/30 701/409

* cited by examiner

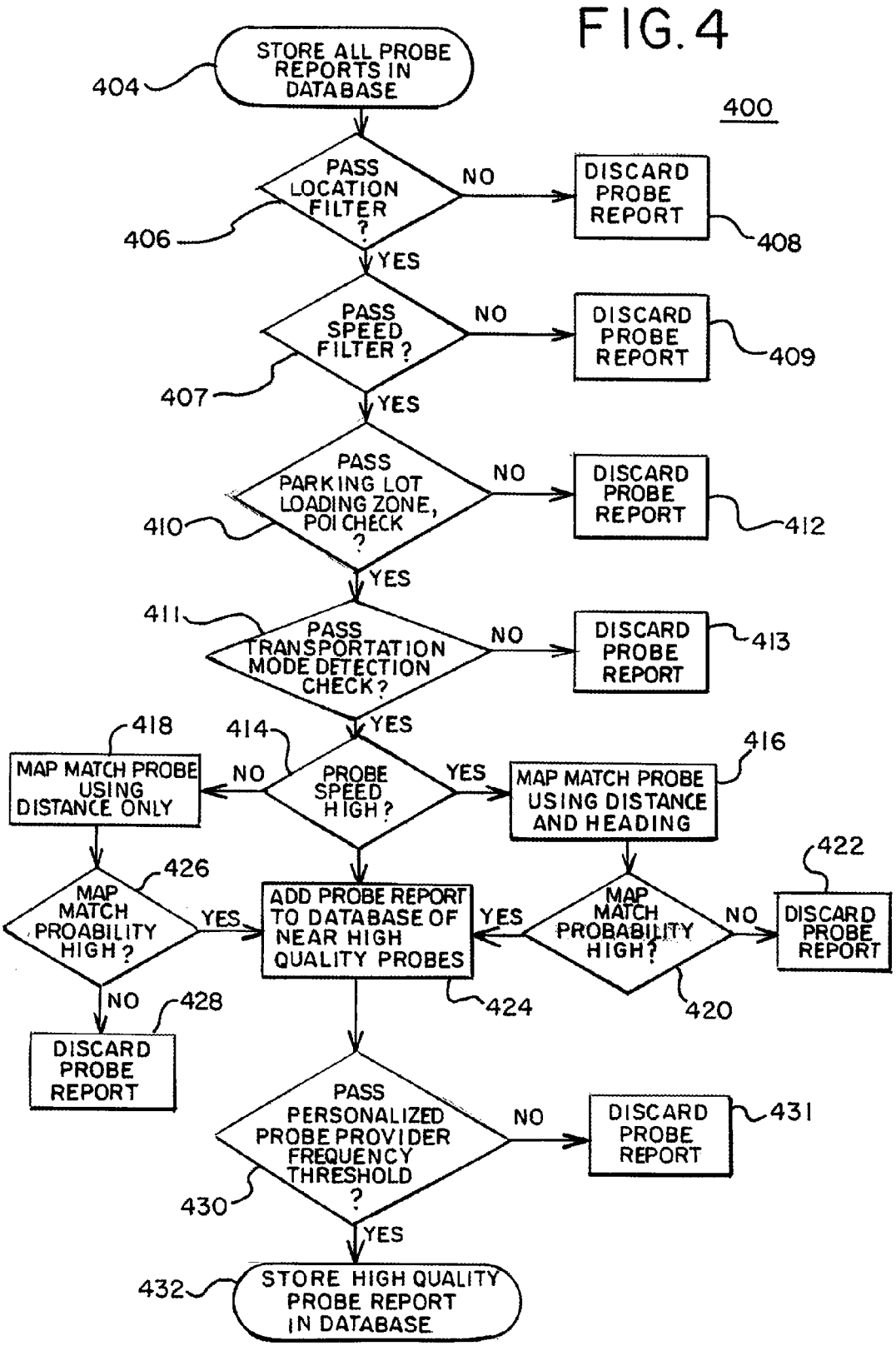
FIG. 4
400
STORE ALL PROBE REPORTS IN DATABASE
404
PASS LOCATION FILTER ?
406
NO
DISCARD PROBE REPORT
408
YES
PASS SPEED FILTER ?
407
NO
DISCARD PROBE REPORT
409
YES
PASS PARKING LOT LOADING ZONE, POI CHECK ?
410
NO
DISCARD PROBE REPORT
412
YES
PASS TRANSPORTATION MODE DETECTION CHECK ?
411
NO
DISCARD PROBE REPORT
413
YES
PROBE SPEED HIGH ?
414
NO
MAP MATCH PROBE USING DISTANCE ONLY
418
YES
MAP MATCH PROBE USING DISTANCE AND HEADING
416
MAP MATCH PROABILITY HIGH ?
426
YES
NO
DISCARD PROBE REPORT
428
ADD PROBE REPORT TO DATABASE OF NEAR HIGH QUALITY PROBES
424
YES
MAP MATCH PROBABILITY HIGH ?
420
NO
DISCARD PROBE REPORT
422
PASS PERSONALIZED PROBE PROVIDER FREQUENCY THRESHOLD ?
430
NO
DISCARD PROBE REPORT
431
YES
STORE HIGH QUALITY PROBE REPORT IN DATABASE
432

DIFFERENTIATION OF PROBE REPORTS BASED ON QUALITY

TECHNICAL FIELD

The present teachings relate generally to navigation, maps, road property estimation systems (e.g., vehicular traffic estimation systems), and the like.

BACKGROUND

In a vehicular traffic system, a probe source (e.g., a probe vehicle equipped with a global positioning system or GPS and/or a commuter equipped with a mobile phone) may transmit periodic satellite-based probe reports indicative of traffic conditions in the vicinity of the probe source. These probe reports may then be processed by a traffic system to model or estimate road conditions (e.g., traffic flow, congestion, travel speed, travel time, etc.), which may be reported back to the system's clients and/or otherwise stored and/or processed.

SUMMARY

The scope of the present invention is defined solely by the appended claims, and is not affected to any degree by the statements within this summary.

By way of introduction, a method in accordance with the present teachings includes: (a) receiving, by a processor, a probe report from a probe source, wherein the probe report includes data indicative of a travel condition; (b) determining, by the processor, whether the probe report satisfies a criterion indicative of high quality data; and (c) identifying, by the processor, the probe report as being (i) suitable for use in modeling the travel condition if the probe report satisfies the criterion, or (ii) unsuitable for use in modeling the travel condition if the probe report does not satisfy the criterion.

An apparatus in accordance with the present teachings includes at least one processor and at least one memory including computer program code for one or more programs. The at least one memory and the computer program code are configured to, with the at least one processor, cause the apparatus to perform at least the following: (a) receive a probe report from a probe source, wherein the probe report includes data indicative of a travel condition; (b) determine whether the probe report satisfies a criterion indicative of high quality data; and (c) identify the probe report as being (i) suitable for use in modeling the travel condition if the probe report satisfies the criterion, or (ii) unsuitable for use in modeling the travel condition if the probe report does not satisfy the criterion.

A non-transitory computer readable storage medium in accordance with the present teachings has stored therein data representing instructions executable by a programmed processor. The storage medium includes instructions for (a) receiving a probe report from a probe source, wherein the probe report comprises data indicative of a travel condition; (b) determining whether the probe report satisfies a criterion indicative of high quality data; and (c) identifying the probe report as being (i) suitable for use in modeling the travel condition if the probe report satisfies the criterion, or (ii) unsuitable for use in modeling the travel condition if the probe report does not satisfy the criterion.

BRIEF DESCRIPTION OF THE DRAWINGS

FIG. 4 shows a flow chart of an exemplary process for differentiating high quality probe reports in a plurality of probe reports.

DETAILED DESCRIPTION

A probe report is a vector of the form (e.g., timestamp, latitude, longitude, heading, speed, probe ID, provider ID, and/or the like) submitted from a probe vehicle or a commuter that provides satellite-based (e.g., GPS) probe reports to a vehicular traffic system, such as the system operated by Nokia Corporation. In the Nokia traffic system, probe reports are received from probe vehicles (e.g., fleets of vehicles equipped with GPS automatic vehicle locators or AVLs that submit probe reports at a specified frequency) and ordinary commuters (e.g., pedestrians and/or commuters providing probe reports from mobile phones equipped with a GPS receiver and/or transmitter).

A vehicular traffic system may receive a great multitude (e.g., billions) of probe reports each month—some of which may not be useful (and, indeed, may be detrimental) to the modeling and estimation performed by the vehicular traffic system. By way of example, probe reports received from commuters traveling on boats or trains may reduce the quality of a vehicular traffic system or other type of road property estimation system that uses such probe reports.

Figure 1:
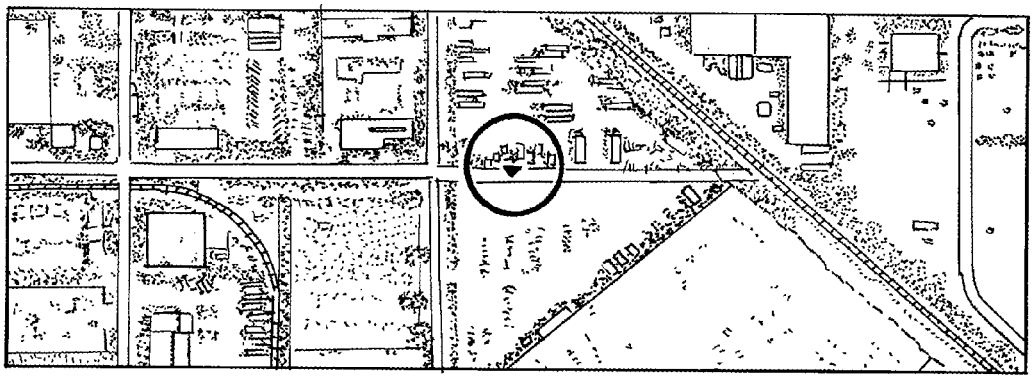
FIG. 1 shows an overhead view of a parking lot in which a parked probe vehicle produces probe reports that may be map-matched to an adjacent road.

Low quality probe reports detrimental to a vehicular traffic system may arise in a variety of situations. For example, in the situation shown in FIG. 1, probe reports produced from a probe vehicle parked in a parking lot may be map-matched to the adjacent road. Since the vehicle is parked, the speed reported to the traffic system is zero, thereby falsely indicating a road congestion that does not in fact exist. Similarly, probe reports produced from a probe vehicle within a point of interest (POI), such as the drive-through lane of a fast food restaurant, may likewise be map-matched to an adjacent road. Since the driver of the vehicle in a drive-through lane is merely waiting to be served, the speed reported to the traffic system from the vehicle is low, thus falsely indicating traffic congestion on the nearby road.

Figure 2:
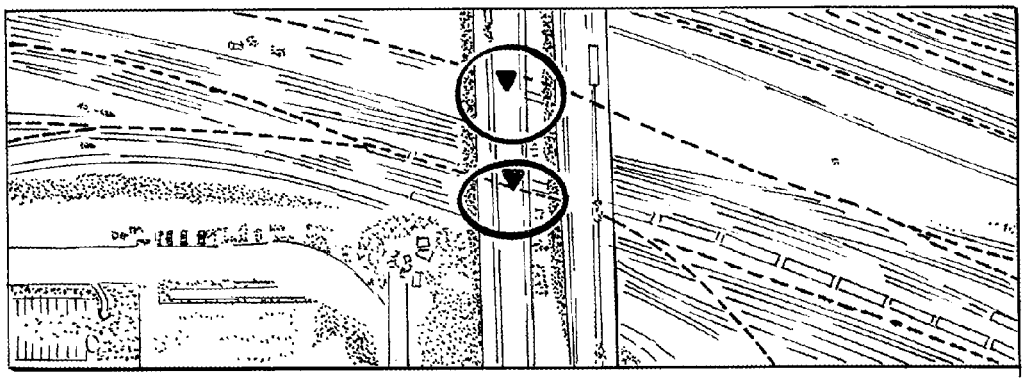
FIG. 2 shows an overhead view of a train traveling transversely to a road in which probe reports produced by a train commuter may be map-matched to the road.

Low quality probe reports may also arise in situations in which train commuters provide probe reports that are map matched to a road adjacent to the train tracks. In such cases, the speed of the train as reported in the probe report may erroneously be identified as the travel speed on the adjacent road to which the probe report is map matched. Moreover, as shown in FIG. 2, the train carrying the commuter may travel transversely to the road, such that the heading reported in the probe report is incompatible with the road direction.

Figure 3:
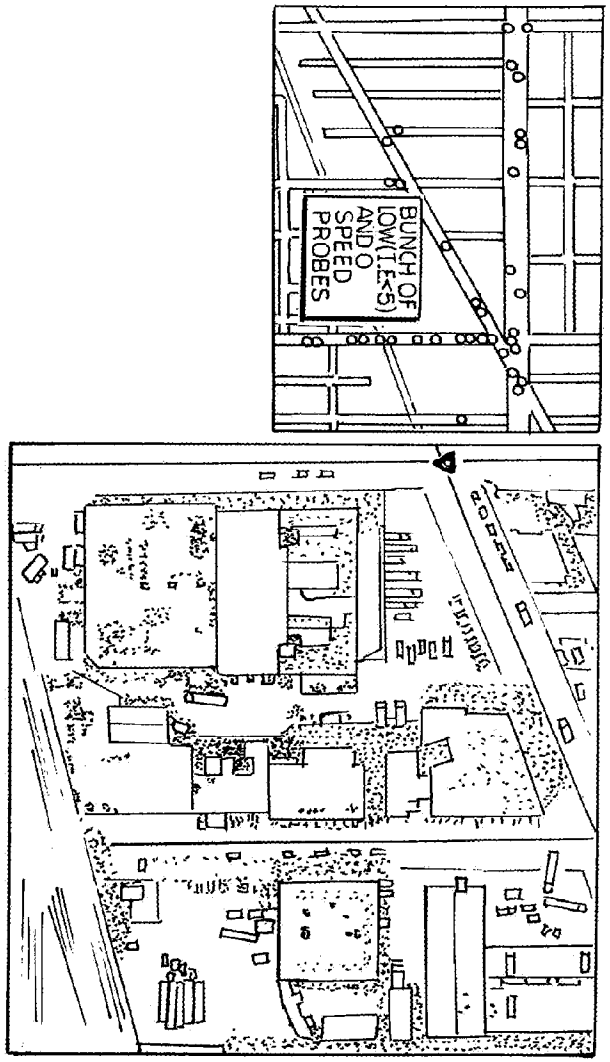
FIG. 3 shows an overhead view of a loading dock in which a fleet of trucks produces probe reports that may be map-matched to an adjacent road.

Low quality probe reports may also arise in situations in which the probe reports are provided by a GPS fleet tracking service. For example, as shown in FIG. 3, one or more fleet vehicles (e.g., delivery trucks) may be parked in a loading zone awaiting loading or unloading. Since one or more of the fleet vehicles may be parked or moving between nearby points within the loading zone, the speed reported to the traffic system may be low (e.g., below about 5 kph) or zero. Moreover, since the dock may be adjacent to the road, the probe reports produced by the fleet vehicles may be map-matched to the road, once again falsely indicating congestion on the road that does not in fact exist.

Low quality probe reports may also arise as a result of the different frequencies (e.g., 30 seconds, 1 minute, 5 minutes, etc.) at which probe providers submit probe reports. For example, a situation may arise in which a vehicle submits a probe report on day 1 prior to its engine being turned off. The next probe report is not submitted until day 2 when the engine is turned back on. However, even though the probe reports were submitted on different days, the traffic system may still compute path speed based on these two probe reports as function of distance and time. Since speed is defined as distance divided by time, the path speed may be falsely calculated as being very low since the time between the probe reports is so long.

When low quality probe reports, including but not limited to the representative types described above, are received and processed in a vehicular traffic system, the quality of the modeling and estimation of actual road and/or traffic conditions may be reduced as a consequence.

Methods and apparatuses for differentiating high quality probe reports from low quality probe reports in a plurality of probe reports provided by a plurality of providers have been discovered and are described herein. Heretofore, conventional vehicular traffic systems for modeling traffic flow, congestion, traffic incidents, and/or the like using data obtained from satellite-based probe reports (e.g., GPS probe reports) have lacked any such mechanism to differentiate high quality probe reports from low quality probe reports.

The algorithms, methods, and systems described herein are generic and may be used in conjunction with any system—including but not limited to vehicular traffic systems (e.g., Nokia's Traffic Incident Management Center, HERE Traffic, and/or the like)—that takes in and utilizes satellite-based probe report data. In some embodiments, the high quality data obtained in accordance with the present teachings may be provided (e.g., in some embodiments, may optionally be sold) to another entity including but not limited to consumers, first responders, city planners, and/or the like.

Throughout this description and in the appended claims, the following definitions are to be understood:

The phrase "high quality" as used in reference to data and/or a probe report indicates that data in the probe report are suitable for use in estimations and/or modeling performed by a system. By way of example, in the case of a vehicular traffic system, a "high quality" probe report comprises data at least a majority of which (e.g., greater than about 50%, in some embodiments greater than about 60%, in some embodiments greater than about 70%, in some embodiments greater than about 80%, in some embodiments greater than about 90%, in some embodiments greater than about 95%, in some embodiments greater than about 99%, and in some embodiments substantially 100%) accurately reflect traffic conditions on a road that has been map matched to the probe report.

Conversely, the phrase "low quality" as used in reference to data and/or a probe report indicates that data in the probe report are unsuitable for use in estimations and/or modeling performed by a system. By way of example, in the case of a vehicular traffic system, a "low quality" probe report comprises data at least a majority of which (e.g., greater than about 50%, in some embodiments greater than about 60%, in some embodiments greater than about 70%, in some embodiments greater than about 80%, in some embodiments greater than about 90%, in some embodiments greater than about 95%, in some embodiments greater than about 99%, and in some embodiments substantially 100%) inaccurately reflect traffic conditions on a road that has been map matched to the probe report (e.g., the data are indicative of congestion when the road is not, in fact, congested).

It is to be understood that elements and features of the various representative embodiments described below may be combined in different ways to produce new embodiments that likewise fall within the scope of the present teachings.

By way of general introduction, a method in accordance with the present teachings for differentiating high quality probe reports in a plurality of probe reports includes: (a) receiving a probe report from a probe source, wherein the probe report comprises data indicative of a travel condition; (b) determining whether the probe report satisfies a criterion indicative of high quality data; and (c) identifying the probe report as being (i) suitable for use in modeling the travel condition if the probe report satisfies the criterion, or (ii) unsuitable for use in modeling the travel condition if the probe report does not satisfy the criterion.

In some embodiments, the probe report comprises a GPS probe report. All manner of probe sources configured for providing probe reports are contemplated for use in accordance with the present teachings, including but not limited to commercial service providers, commuters with mobile phones, fleets of commercial vehicles (e.g., delivery services, livery services, etc.), and/or the like. In some embodiments, the probe source is selected from the group consisting of probe vehicles (e.g., fleet and/or non-fleet vehicles), commuters, and combinations thereof.

In some embodiments, a method in accordance with the present teachings further comprises receiving a plurality of probe reports from one or a plurality of probe sources and, in some embodiments, determining whether one, a plurality (e.g., two or more), and/or an entirety of the plurality of probe reports pass or fail the criterion. In some embodiments, a method in accordance with the present teachings further comprises determining whether the probe report satisfies a plurality of criteria. In some embodiments, each of the plurality of criteria is independently indicative of high quality data. In other embodiments, two or more of the plurality of criteria, when taken together, are collectively indicative of high quality data.

In some embodiments, a method in accordance with the present teachings further comprises map matching the probe report based on distance and heading if a speed in the probe report is greater than or equal to a predefined threshold. In some embodiments, a method in accordance with the present teachings further comprises map matching the probe report based on distance without heading if a speed is less than or equal to a predefined threshold.

In some embodiments, a method in accordance with the present teachings further comprises determining whether one or a plurality of probe reports received from one or a plurality of probe sources satisfies a plurality of criteria. In some embodiments, the criteria are selected from the group consisting of (a) determining whether the probe report emanated from a location within a predefined boundary; (b) determining whether a speed is positive or negative; (c) determining whether a speed is less than or equal to a predefined threshold;

(d) determining whether the probe report emanated from within a predefined boundary associated with a parking lot, a loading zone, a point of interest, or a combination thereof; (e) determining whether the probe report emanated from a relevant transportation mode (e.g., cars, trucks, buses, and/or the like, and combinations thereof); (f) determining whether a probability of map matching the probe report is greater than or equal to a predefined threshold; (g) determining whether a time difference between consecutive probe reports from the probe source exceeds a predefined frequency submission; and/or the like; and combinations thereof.

In some embodiments, a method in accordance with the present teachings is implemented using a computer and, in some embodiments, one or a plurality of the above-described acts are performed by one or a plurality of processors. In some embodiments, one or more of the one or the plurality of processors include graphics processing units (GPUs). In other embodiments, one or more of the one or the plurality of processors include central processing units (CPUs). In some embodiments, methods in accordance with the present teachings are implemented entirely on GPUs. In some embodiments, GPUs provide improved and/or faster performance.

FIG. 4 shows a flow chart of an exemplary process 400 in accordance with the present teachings for differentiating high quality probe reports in a plurality of probe reports. It is to be understood that the relative ordering of some acts shown in the flow chart of FIG. 4 is meant to be merely representative rather than limiting, and that alternative sequences may be followed. Moreover, it is likewise to be understood that additional, different, or fewer acts may be provided, and that two or more of these acts may occur sequentially, substantially contemporaneously, and/or in alternative orders.

In a representative first phase, probe reports for potential use in a traffic system may be collected from a variety of different probe sources (e.g., probe vehicles, travelers with GPS-enabled mobile phones, other satellite-based systems used for location determination, and/or the like). The probe reports may be submitted from planes, trains, cars, biking travellers, walking travelers, and/or the like, and optionally stored in a database, as shown at block 404 of FIG. 4. In some embodiments, the probe reports stored in a database at block 404 may be evaluated in the order in which they are received. In other embodiments, the probe reports may be evaluated based on priority (e.g., identity of probe source, timestamp, etc.). In further embodiments, the probe reports may be evaluated using a combination of both order of receipt and priority.

At decision block 406 in FIG. 4, a determination is made as to whether the probe reports pass or fail a location filter. In some embodiments, the location filter may be implemented as a boundary (e.g., a bounding box) around a region of interest. Thus, if it is determined that a probe report emanates from within the boundary, the probe report passes the location filter. However, if it is determined that a probe report emanates from outside the boundary, the probe report fails the location filter and is discarded. In such a manner, probe reports associated with contextually unreasonable locations as a result of GPS errors may be ferreted out and discarded.

If the probe report fails the location filter at decision block 406, the probe report is discarded, as shown at block 408. However, if the probe report passes the location filter at decision block 406, the process may proceed. At decision block 407 in FIG. 4, a determination is made as to whether the probe report passes or fails a speed filter. In some embodiments, the speed filter may be implemented as an upper threshold (e.g., 200 mph) at or above which a speed is deemed unrealistic and the probe report is discarded. In addition, the speed filter may additionally or alternatively be implemented to discard probe reports associated with negative speeds (e.g., such as those resulting from time computation errors).

If the probe report fails the speed filter at decision block 407, the probe report is discarded, as shown at block 409. However, if the probe report passes the speed filter at decision block 407, the process may proceed. In a representative next phase, as shown at block 410, a check is performed to assess whether the probe report emanated from within a parking lot, loading zone, or POI. For this phase, a database of places that maintains geometries representing parking lots, loading docks, and POIs (e.g. fast-food drive-throughs) may be queried. Given the probe report's location and geometries, a determination may be made as to whether the location property of the probe report lies within a boundary (e.g., a bounding box). If it is determined that the probe report was submitted from within a boundary representing a parking lot, loading dock, or POI, the probe report may be suppressed as being of low quality, as shown at block 412.

If, however, the probe report did not emanate from a parking lot, loading dock, or POI, the process may proceed. At decision block 411, a check is performed to assess whether the probe report emanated from a relevant mode of transportation. Transportation mode detection identifies a commuter's mode of transportation (e.g., car, bus, aboveground train, boat, walking, bike, stationary, etc.) from sensor data (e.g. GPS data). Transportation mode detection is described in the literature, and all manner of transportation mode detection—including but not limited to that described in a paper by Leon Stenneth et al. entitled "Transportation Mode Detection using Mobile Phones and GIS Information," which was presented at the 19th ACM SIGSPATIAL International Conference on Advances in Geographic Information Systems (ACM SIGSPATIAL GIS 2011), Nov. 1-4 2011 (Chicago, Ill.)—for identifying a commuter's mode of transportation (e.g. car, bus, train, bike, walk, stationary) from GPS data is contemplated for use in accordance with the present teachings. In some embodiments of a vehicular traffic system, only probe reports submitted from cars and/or trucks are of interest. In other embodiments, probe reports from bus commuters may also be of interest although such probe reports may involve different processing (e.g., increasing reported speeds by about 5-10 kph for traffic usage). However, probe reports from the mobile phones of pedestrians and/or from the mobile phones of commuters traveling on trains, boats, planes, and bikes are deemed of low quality and may not be used for traffic estimation. Thus, at decision block 411 in FIG. 4, a decision is made as to whether the probe report emanated from a relevant transportation mode. If it is determined that the probe report issued from an irrelevant mode of transportation, the probe report is discarded, as shown at block 413. However, if the probe report issued from a relevant mode of transportation, the process may proceed.

Figure 5:
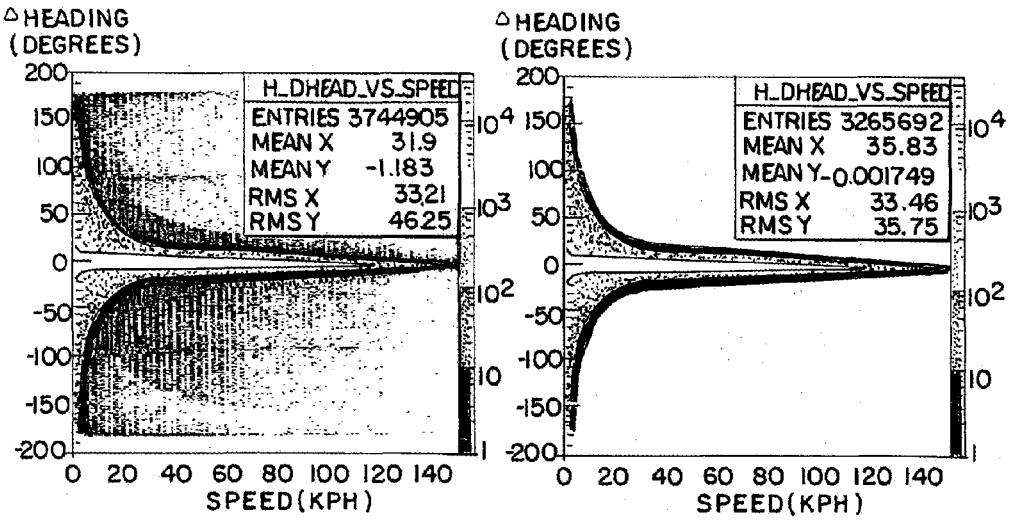
FIG. 5 shows plots of heading versus speed for an uncleaned probe report (left) and a cleaned probe report (right).

In a representative next phase, beginning at decision block 414, a decision is made regarding which variation of map matching to use based on whether the speed contained in the probe report is high or low. If the probe report speed is greater than a predefined reasonable speed threshold (e.g., 10 kph), the probe report is map matched to the road's geometry using two properties—(1) distance of the probe report from the road and (2) heading of the probe report—as shown at block 416. However, if the speed is low (e.g. less than 10 kph), the probe report is map-matched using only distance, as shown at block 418. The reason for this distinction is that GPS heading is not reliable at low speed. For example, FIG. 5 shows plots of heading versus speed according to experiment. The heading error is the deviation from the zero point on the x-axis. As shown in the plot on the left in FIG. 5, which corresponds to uncleaned probe report data, heading error is very prominent at low speed. However, after cleaning the data as shown in the plot on the right of FIG. 5 (e.g., by map-matching at low speed based on distance alone), a substantial portion of the heading error is removed. However, residual heading error is still present at low speed in the right-hand plot due to intrinsic poor GPS heading at low speed.

Regardless of whether map matching is accomplished using both distance and heading, as shown at block 416, or using distance alone, as shown at block 418, a determination may be made as to whether the probability of the map matching meets or exceeds a predefined threshold in order to decide whether a probe report should be discarded. If the map matching probability for a candidate probe report and the adjacent road is below the threshold, the probe report may be suppressed as being of low quality. For example, in the case of a high speed probe report, a determination is made at decision block 420 as to whether the map matching probability for the high-speed probe report meets or exceeds a predefined threshold. If the threshold is not met, such that the probability is deemed low, the probe report is discarded, as shown at block 422. However, if the threshold is satisfied, such that the probability is deemed high, the probe report may be added to a repository of near high quality probe reports, as shown at block 424. Similarly, in the case of a low speed probe report, a determination is made at decision block 426 as to whether the map matching probability for the low speed probe report meets or exceeds a predefined threshold. If the threshold is not met, such that the probability is deemed low, the probe report is discarded, as shown at block 428. However, if the threshold is satisfied, such that the probability is deemed high, the probe report may be added to a repository of near high quality probe reports, as shown at block 424.

In a representative final phase, as shown at block 430 of FIG. 4, probe provider frequency suppression may be performed. If the probe report fails to satisfy the personalized probe provider frequency threshold, the probe report may be discarded, as shown at block 431. However, if the threshold is satisfied, the probe report may be added to a repository of high quality probe reports, as shown at block 432.

Figure 6:
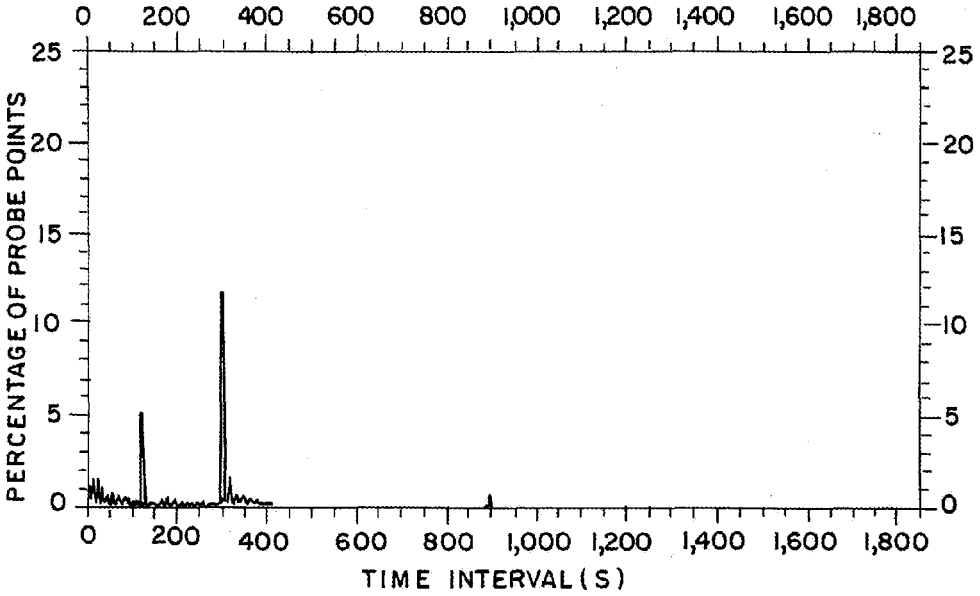
FIG. 6 shows a graph of multiple frequencies at which a representative probe provider may submit probe reports.

As described above, probe providers may submit probe reports at different frequencies. For example, some providers may submit probe reports every 5 minutes, whereas other providers may submit probe reports every 60 seconds, every 30 seconds, and/or the like. Moreover, as shown in FIG. 6, some providers may submit probes at multiple frequencies. For example, a provider may submit probe reports at both two-minute and five-minute intervals, as shown in FIG. 6.

In the absence of probe provider frequency suppression (e.g., by taking timestamp into consideration for path speed computations), a situation may arise in which a vehicle submits a probe $P_1$ on a road that is map matched correctly to the probe. Subsequently, the vehicle enters a parking lot. While in the parking lot, the vehicle continues to submit probes $P_2$, $P_3$, . . . , $P_{N-1}$ which are not map matched due to distance from the road and/or other constraints. Upon leaving the parking lot and returning to the road, the vehicle submits another probe $P_N$ that is map matched to the road. Since probes $P_2$, $P_3$, . . . , $P_{N-1}$ were suppressed, the router will then compute the speed relative to the distance and time difference between probes $P_1$ and $P_N$. Since the time between these probes is long but the distance is short, a low speed is calculated and traffic congestion is falsely identified.

To mitigate this situation, in some embodiments, a static frequency threshold may be applied for all probe providers (e.g., in some embodiments, 5 minutes). Thus, consecutive probe reports from any single provider with a timestamp difference that is greater than 5 minutes may not used for path speed computation. In some embodiments, a static frequency threshold may be useful. In other embodiments, a personalized frequency threshold per probe provider may be used.

Personalized probe provider frequency suppression may be used to improve the quality of probe reports submitted into a traffic engine by defining personalized frequency thresholds at or above which a probe report may be deemed of low quality and discarded. By way of example, in some embodiments, a probe provider with a frequency of 1 second may have a frequency threshold of 2 to 3 seconds. In some embodiments, a probe provider with a frequency of 5 minutes may have a frequency threshold of 6 to 7 minutes. In some embodiments, a probe provider with multiple frequencies may have a frequency threshold determined with respect to the largest significant frequency. For example, as shown in FIG. 6, a probe provider that submits probe reports at 2 minutes and 5 minutes may have a frequency threshold such that any probes submitted at frequencies much greater than 5 minutes may be pruned as being of low quality.

Personalized probe provider frequency suppression may be achieved in a variety of ways. For example, in a first approach, probe reports may be bucketed into frequencies at per second granularity. Each possible frequency may be assigned a weight representing the percentage of probes submitted in that period. The algorithm may use the largest significant probe reporting frequency as a cutoff point. Significance may be determined with regards to the percentage of probe reports at a given frequency and a predefined threshold. In some embodiments, the significance threshold may be 0.10%. The algorithm may start from the lowest possible frequency and try to find the lowest frequency with no less than 0.10% of the total number of probes reported in one day. After finding this frequency, the algorithm may add an additional one second.

In an alternative approach, probe reports may again be bucketed into frequencies at per second granularity with each possible frequency being assigned a weight representing the percentage of probes submitted in that period. The algorithm may start from the lowest possible frequency and consider a predefined fraction representing an acceptable pruning percentage of the probe data. In some embodiments, the predefined fraction is 3.0%. Each possible frequency is assigned a weight representing the percentage of probes submitted in that period. Starting from the lowest possible frequency, the algorithm continues to sum the weights until the threshold is dominated.

In a third approach, a hybrid of the two above-described approaches may be used.

As noted above, it is to be understood that the relative ordering of some acts shown in the flow chart of FIG. 4 is meant to be merely representative rather than limiting, and that alternative sequences may be followed. Moreover, as also noted above, it is likewise to be understood that additional, different, or fewer acts may be provided, and that two or more of these acts may occur sequentially, substantially contemporaneously, and/or in alternative orders. By way of a non-limiting and representative example, in FIG. 4, the act 406 of determining whether the probe report passes or fails as location filter is shown as preceding the act 430 of determining whether the probe report satisfies a personalized probe provider frequency threshold. However, in alternative embodiments, the ordering of these acts may be reversed. Moreover, in alternative embodiments, one or both of these acts may be omitted from the process.

In addition, methods in accordance with the present teachings may likewise include additional acts that are not shown in the representative flow chart in FIG. 4. By way of example, in some embodiments, a determination may be made as to whether or not a heading contained in a probe report is compatible with a road direction. If the heading is deemed incompatible (e.g., a heading contained in a probe report submitted from the mobile phone of a train commuter travelling on rail tracks that are transverse to a road, as shown in FIG. 2), the probe report may be discarded as being of low quality. If the heading is deemed compatible, the process may proceed.

In some embodiments, as described above, the present teachings provide methods for differentiating high quality probe reports in a plurality of probe reports. In other embodiments, as further described below, the present teachings also provide apparatuses for differentiating high quality probe reports in a plurality of probe reports.

Figure 7:
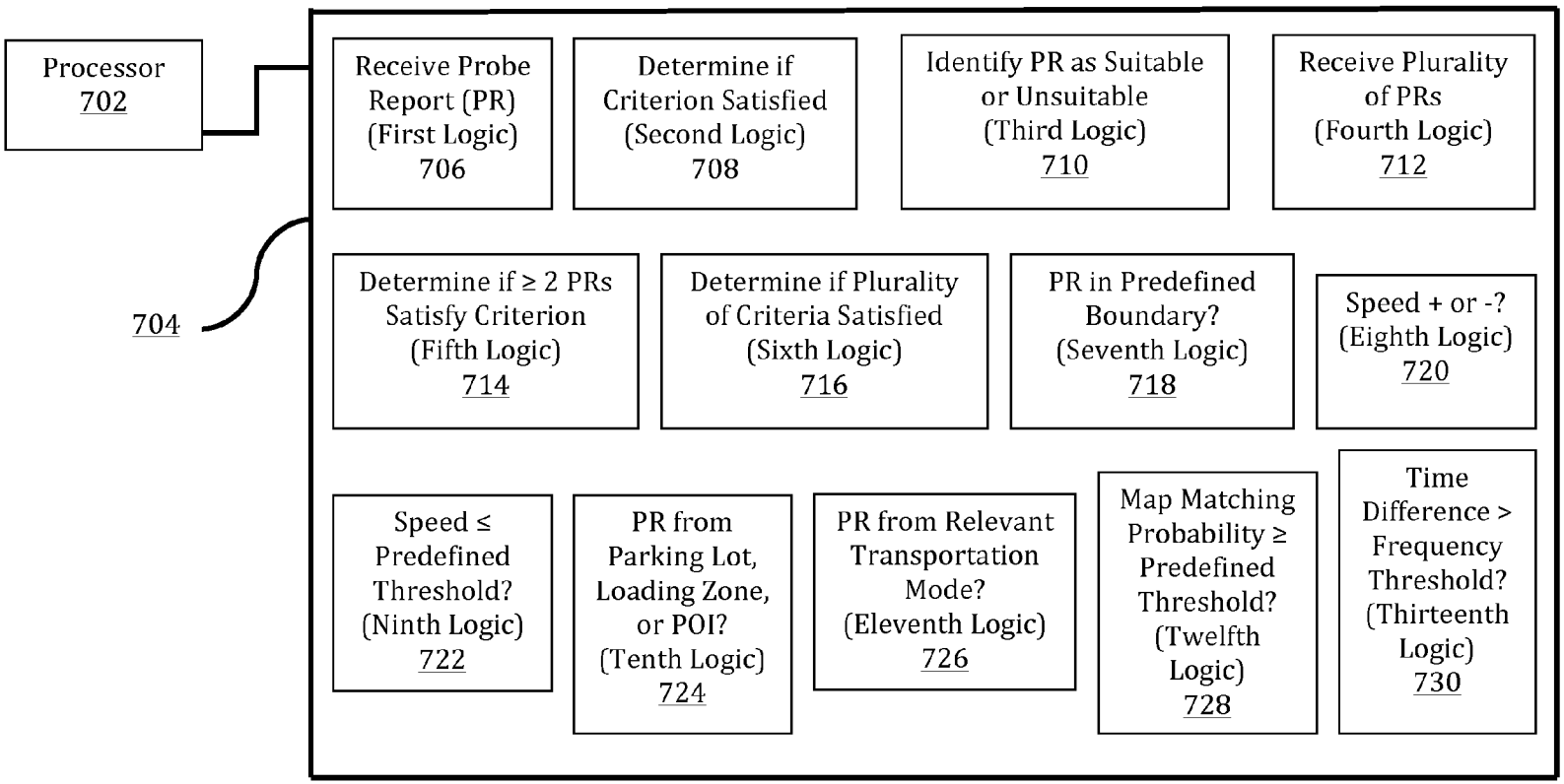
FIG. 7 shows a block diagram of a representative apparatus 700 in accordance with the present teachings for differentiating high quality probe reports in a plurality of probe reports.

FIG. 7 shows a block diagram of a representative first apparatus 700 in accordance with the present teachings for differentiating high quality probe reports in a plurality of probe reports. In some embodiments, as shown in FIG. 7, an apparatus 700 in accordance with the present teachings is implemented as part of a GPU in a computer system. In other embodiments, the apparatus 700 may be implemented as part of a CPU in a computer system.

In some embodiments, as shown in FIG. 7, the apparatus 700 may include: a processor 702; a non-transitory memory 704 coupled with the processor 702; first logic 706 stored in the non-transitory memory 704 and executable by the processor 702 to cause the apparatus 700 to receive a probe report (PR) from a probe source, wherein the probe report comprises data indicative of a travel condition; second logic 708 stored in the non-transitory memory 704 and executable by the processor 702 to cause the apparatus 700 to determine whether the probe report satisfies a criterion indicative of high quality data; and third logic 710 stored in the non-transitory memory 704 and executable by the processor 702 to cause the apparatus 700 to identify the probe report as being (i) suitable for use in modeling the travel condition if the probe report satisfies the criterion, or (ii) unsuitable for use in modeling the travel condition if the probe report does not satisfy the criterion.

In some embodiments, the apparatus 700 may further include one or more of the following: fourth logic 712 stored in the non-transitory memory 704 and executable by the processor 702 to cause the apparatus 700 to receive a plurality of probe reports from one or a plurality of probe sources; fifth logic 714 stored in the non-transitory memory 704 and executable by the processor 702 to cause the apparatus 700 to determine whether two or more of the plurality of probe reports satisfy the criterion; sixth logic 716 stored in the non-transitory memory 704 and executable by the processor 702 to cause the apparatus 700 to determine whether the probe report satisfies a plurality of criteria; seventh logic 718 stored in the non-transitory memory 704 and executable by the processor 702 to cause the apparatus 700 to determine whether the probe report emanated from a location within a predefined boundary; eighth logic 720 stored in the non-transitory memory 704 and executable by the processor 702 to cause the apparatus 700 to determine whether a speed is positive or negative; ninth logic 722 stored in the non-transitory memory 704 and executable by the processor 702 to cause the apparatus 700 to determine whether a speed is less than or equal to a predefined threshold; tenth logic 724 stored in the non-transitory memory 704 and executable by the processor 702 to cause the apparatus 700 to determine whether the probe report emanated from within a predefined boundary associated with a parking lot, a loading zone, a point of interest, or a combination thereof; eleventh logic 726 stored in the non-transitory memory 704 and executable by the processor 702 to cause the apparatus 700 to determine whether the probe report emanated from a relevant transportation mode (e.g., cars, trucks, buses, and/or the like, and combinations thereof); twelfth logic 728 stored in the non-transitory memory 704 and executable by the processor 702 to cause the apparatus 700 to determine whether a probability of map matching the probe report is greater than or equal to a predefined threshold; and/or thirteenth logic 730 stored in the non-transitory memory 704 and executable by the processor 702 to cause the apparatus 700 to determine whether a time difference between consecutive probe reports from the probe source exceeds a predefined frequency submission.

In some embodiments, the apparatus 700 is configured as a device selected from the group consisting of navigation systems, mobile phones, personal computers, game consoles, laptops, notebooks, tablets, portable media players, personal digital assistants, pagers, and the like, and combinations thereof. In some embodiments, the apparatus 700 is configured as a navigation system and/or a mobile phone and further includes: (a) user interface circuitry and user interface software configured to (i) facilitate user control of at least some functions of the navigation system and/or mobile phone though use of a display and (ii) respond to user inputs; and (b) a display and display circuitry configured to display at least a portion of a user interface of the navigation system and/or mobile phone, the display and the display circuitry configured to facilitate user control of at least some of the functions of the navigation system and/or mobile phone.

A second apparatus for differentiating high quality probe reports in a plurality of probe reports in accordance with the present teachings includes (a) means for receiving a probe report from a probe source, wherein the probe report comprises data indicative of a travel condition; (b) means for determining whether the probe report satisfies a criterion indicative of high quality data; and (c) means for identifying the probe report as being (i) suitable for use in modeling the travel condition if the probe report satisfies the criterion, or (ii) unsuitable for use in modeling the travel condition if the probe report does not satisfy the criterion.

A non-transitory computer-readable storage medium in accordance with the present teachings has stored therein data representing instructions executable by a programmed processor for differentiating high quality probe reports in a plurality of probe reports. The storage medium includes instructions for: (a) receiving a probe report from a probe source, wherein the probe report comprises data indicative of a travel condition; (b) determining whether the probe report satisfies a criterion indicative of high quality data; and (c) identifying the probe report as being (i) suitable for use in modeling the travel condition if the probe report satisfies the criterion, or (ii) unsuitable for use in modeling the travel condition if the probe report does not satisfy the criterion.

One skilled in the art will appreciate that one or more modules or logic described herein may be implemented using, among other things, a tangible computer-readable medium comprising computer-executable instructions (e.g., executable software code). Alternatively, modules may be implemented as software code, firmware code, hardware, and/or a combination of the aforementioned.

Figure 8:
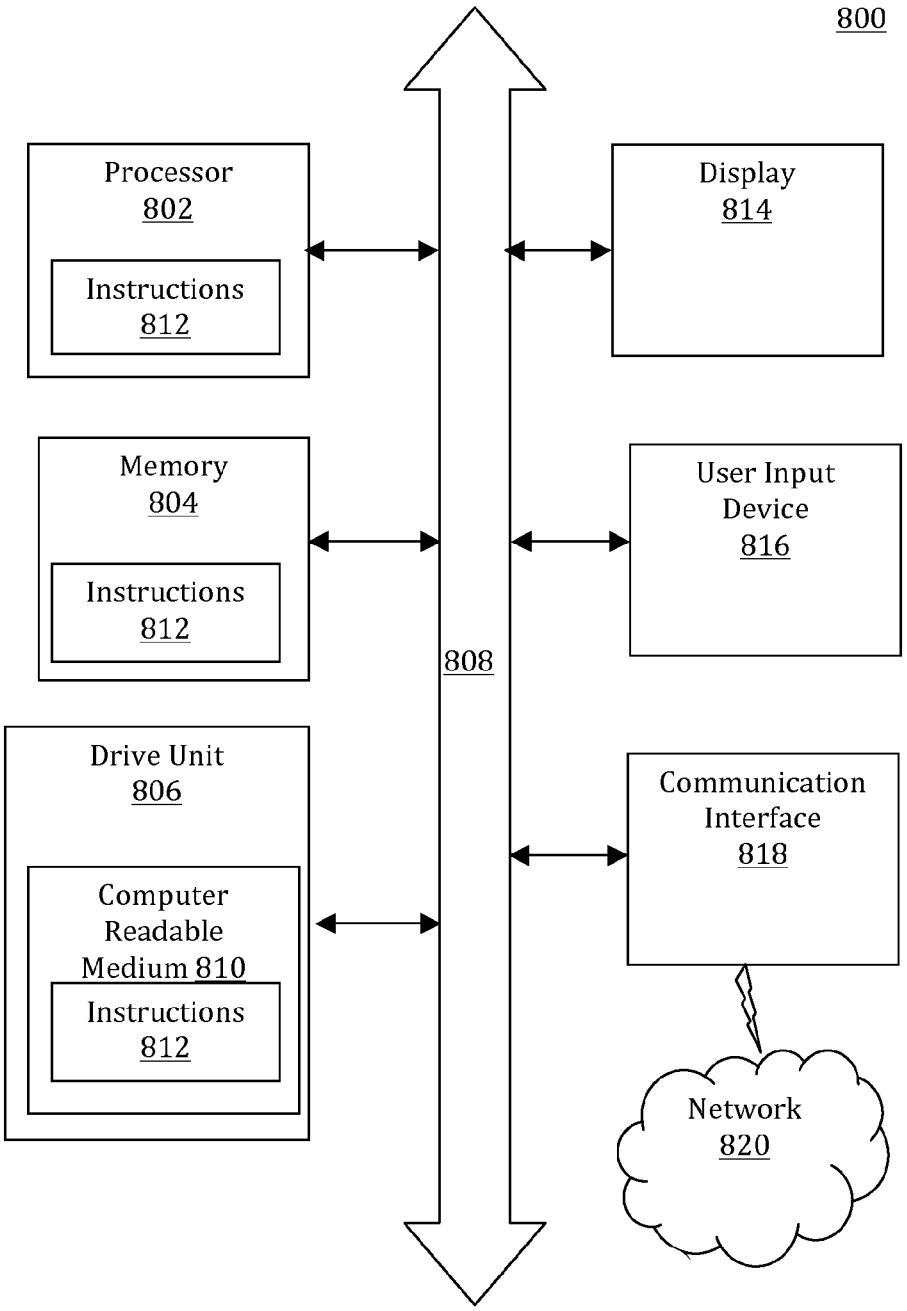
FIG. 8 shows a representative general computer system 800 for use with an apparatus in accordance with the present teachings.

FIG. 8 depicts an illustrative embodiment of a general computer system 800. The computer system 800 can include a set of instructions that can be executed to cause the computer system 800 to perform any one or more of the methods or computer based functions disclosed herein. The computer system 800 may operate as a standalone device or may be connected (e.g., using a network) to other computer systems or peripheral devices. Any of the components discussed above, such as the processor, may be a computer system 800 or a component in the computer system 800. The computer system 800 may implement a differentiation module for differentiating high quality probe reports from low quality probe reports in a plurality of probe reports provided by a plurality of providers, of which the disclosed embodiments are a component thereof.

In a networked deployment, the computer system 800 may operate in the capacity of a server or as a client user computer in a client-server user network environment, or as a peer computer system in a peer-to-peer (or distributed) network environment. The computer system 800 can also be implemented as or incorporated into various devices, such as a personal computer (PC), a tablet PC, a set-top box (STB), a personal digital assistant (PDA), a mobile device, a palmtop computer, a laptop computer, a desktop computer, a communications device, a wireless telephone, a landline telephone, a control system, a camera, a scanner, a facsimile machine, a printer, a pager, a personal trusted device, a web appliance, a network router, switch or bridge, or any other machine capable of executing a set of instructions (sequential or otherwise) that specify actions to be taken by that machine. In some embodiments, the computer system 800 can be implemented using electronic devices that provide voice, video or data communication. Further, while a single computer system 800 is illustrated, the term "system" shall also be taken to include any collection of systems or sub-systems that individually or jointly execute a set, or multiple sets, of instructions to perform one or more computer functions.

As shown in FIG. 8, the computer system 800 may include a processor 802, for example a central processing unit (CPU), a graphics-processing unit (GPU), or both. The processor 802 may be a component in a variety of systems. For example, the processor 802 may be part of a standard personal computer or a workstation. The processor 802 may be one or more general processors, digital signal processors, application specific integrated circuits, field programmable gate arrays, servers, networks, digital circuits, analog circuits, combinations thereof, or other now known or later developed devices for analyzing and processing data. The processor 802 may implement a software program, such as code generated manually (i.e., programmed).

The computer system 800 may include a memory 804 that can communicate via a bus 808. The memory 804 may be a main memory, a static memory, or a dynamic memory. The memory 804 may include, but is not limited to, computer-readable storage media such as various types of volatile and non-volatile storage media, including but not limited to random access memory, read-only memory, programmable read-only memory, electrically programmable read-only memory, electrically erasable read-only memory, flash memory, magnetic tape or disk, optical media and the like. In some embodiments, the memory 804 includes a cache or random access memory for the processor 802. In alternative embodiments, the memory 804 is separate from the processor 802, such as a cache memory of a processor, the system memory, or other memory. The memory 804 may be an external storage device or database for storing data. Examples include a hard drive, compact disc (CD), digital video disc (DVD), memory card, memory stick, floppy disc, universal serial bus (USB) memory device, or any other device operative to store data. The memory 804 is operable to store instructions executable by the processor 802. The functions, acts or tasks illustrated in the figures or described herein may be performed by the programmed processor 802 executing the instructions 812 stored in the memory 804. The functions, acts or tasks are independent of the particular type of instructions set, storage media, processor or processing strategy and may be performed by software, hardware, integrated circuits, firm-ware, micro-code and the like, operating alone or in combination. Likewise, processing strategies may include multiprocessing, multitasking, parallel processing and the like.

As shown in FIG. 8, the computer system 800 may further include a display unit 814, such as a liquid crystal display (LCD), an organic light emitting diode (OLED), a flat panel display, a solid state display, a cathode ray tube (CRT), a projector, a printer or other now known or later developed display device for outputting determined information. The display 814 may act as an interface for the user to see the functioning of the processor 802, or specifically as an interface with the software stored in the memory 804 or in the drive unit 806.

Additionally, as shown in FIG. 8, the computer system 800 may include an input device 816 configured to allow a user to interact with any of the components of system 800. The input device 816 may be a number pad, a keyboard, or a cursor control device, such as a mouse, or a joystick, touch screen display, remote control or any other device operative to interact with the system 800.

In some embodiments, as shown in FIG. 8, the computer system 800 may also include a disk or optical drive unit 806. The disk drive unit 806 may include a computer-readable medium 810 in which one or more sets of instructions 812 (e.g., software) can be embedded. Further, the instructions 812 may embody one or more of the methods or logic as described herein. In some embodiments, the instructions 812 may reside completely, or at least partially, within the memory 804 and/or within the processor 802 during execution by the computer system 800. The memory 804 and the processor 802 also may include computer-readable media as described above.

The present teachings contemplate a computer-readable medium that includes instructions 812 or receives and executes instructions 812 responsive to a propagated signal, so that a device connected to a network 820 can communicate voice, video, audio, images or any other data over the network 820. Further, the instructions 812 may be transmitted or received over the network 820 via a communication interface 818. The communication interface 818 may be a part of the processor 802 or may be a separate component. The communication interface 818 may be created in software or may be a physical connection in hardware. The communication interface 818 is configured to connect with a network 820, external media, the display 814, or any other components in system 800, or combinations thereof. The connection with the network 820 may be a physical connection, such as a wired Ethernet connection or may be established wirelessly as discussed below. Likewise, the additional connections with other components of the system 800 may be physical connections or may be established wirelessly.

The network 820 may include wired networks, wireless networks, or combinations thereof. The wireless network may be a cellular telephone network, an 802.11, 802.16, 802.20, or WiMax network. Further, the network 820 may be a public network, such as the Internet, a private network, such as an intranet, or combinations thereof, and may utilize a variety of networking protocols now available or later developed including, but not limited to TCP/IP based networking protocols.

Embodiments of the subject matter and the functional operations described in this specification can be implemented in digital electronic circuitry, or in computer software, firmware, or hardware, including the structures disclosed in this specification and their structural equivalents, or in combinations of one or more of them. Embodiments of subject matter described in this specification can be implemented as one or more computer program products, for example, one or more modules of computer program instructions encoded on a computer-readable medium for execution by, or to control the operation of, data processing apparatus. While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein. The computer-readable medium can be a machine-readable storage device, a machine-readable storage substrate, a memory device, or a combination of one or more of them. The term "data processing apparatus" encompasses all apparatuses, devices, and machines for processing data, including but not limited to, by way of example, a programmable processor, a computer, or multiple processors or computers. The apparatus can include, in addition to hardware, code that creates an execution environment for the computer program in question (e.g., code that constitutes processor firmware, a protocol stack, a database management system, an operating system, or a combination thereof).

In some embodiments, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the present teachings are considered to include any one or more of a computer-readable medium or a distribution medium and other equivalents and successor media, in which data or instructions may be stored.

In some embodiments, dedicated hardware implementations, such as application specific integrated circuits, programmable logic arrays, and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In some embodiments, the methods described herein may be implemented by software programs executable by a computer system. Further, in some embodiments, implementations can include distributed processing, component/object distributed processing, and parallel processing. Alternatively, virtual computer system processing can be constructed to implement one or more of the methods or functionality as described herein.

Although the present teachings describe components and functions that may be implemented in particular embodiments with reference to particular standards and protocols, the present invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described herein can be performed by one or more programmable processors executing one or more computer programs to perform functions by operating on input data and generating output. The processes and logic flows can also be performed by, and apparatus can also be implemented as, special purpose logic circuitry, for example, an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The main elements of a computer are a processor for performing instructions and one or more memory devices for storing instructions and data. Generally, a computer will also include, or be operatively coupled to receive data from or transfer data to, or both, one or more mass storage devices for storing data, for example, magnetic, magneto optical disks, or optical disks. However, a computer need not have such devices. Moreover, a computer can be embedded in another device, for example, a mobile telephone, a personal digital assistant (PDA), a mobile audio player, a Global Positioning System (GPS) receiver, to name just a few. Computer-readable media suitable for storing computer program instructions and data include all forms of non volatile memory, media and memory devices, including but not limited to, by way of example, semiconductor memory devices (e.g., EPROM, EEPROM, and flash memory devices); magnetic disks (e.g., internal hard disks or removable disks); magneto optical disks; and CD ROM and DVD-ROM disks. The processor and the memory can be supplemented by, or incorporated in, special purpose logic circuitry.

To provide for interaction with a user, some embodiments of subject matter described herein can be implemented on a device having a display, for example a CRT (cathode ray tube) or LCD (liquid crystal display) monitor, for displaying information to the user and a keyboard and a pointing device, for example a mouse or a trackball, by which the user can provide input to the computer. Other kinds of devices can be used to provide for interaction with a user as well. By way of example, feedback provided to the user can be any form of sensory feedback (e.g., visual feedback, auditory feedback, or tactile feedback); and input from the user can be received in any form, including but not limited to acoustic, speech, or tactile input.

Embodiments of subject matter described herein can be implemented in a computing system that includes a back-end component, for example, as a data server, or that includes a middleware component, for example, an application server, or that includes a front end component, for example, a client computer having a graphical user interface or a Web browser through which a user can interact with an implementation of the subject matter described in this specification, or any combination of one or more such back end, middleware, or front end components. The components of the system can be interconnected by any form or medium of digital data communication, for example, a communication network. Examples of communication networks include but are not limited to a local area network (LAN) and a wide area network (WAN), for example, the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 CFR §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding claim—whether independent or dependent—and that such new combinations are to be understood as forming a part of the present specification.

The foregoing detailed description and the accompanying drawings have been provided by way of explanation and illustration, and are not intended to limit the scope of the appended claims. Many variations in the presently preferred embodiments illustrated herein will be apparent to one of ordinary skill in the art, and remain within the scope of the appended claims and their equivalents.

The invention claimed is:

1. A method comprising:

receiving, by a processor, a probe report from a probe sensor, wherein the probe report comprises data indicative of a travel condition;

determining, by the processor, whether the probe report emanated from within a redefined boundary associated with a parking lot, a loading zone, or a combination thereof;

determining, by the processor, whether the probe report meets or exceeds a predefined speed threshold;

determining, by the processor, whether a heading contained in the probe report is compatible with a road direction; and identifying, by the processor, the probe report as being suitable for use in modeling the travel condition if the probe report does not emanate from within the predefined boundary, the probe report meets a predefined speed threshold, and the probe report contains a heading that is compatible with the road direction.

2. The method of claim 1 further comprising:

receiving, by the processor, a plurality of probe reports from one or a plurality of probe sources; and identifying, by the processor, whether two or more of the plurality of probe reports are suitable for use in modeling the travel condition.

3. The method of claim 1 wherein the probe report comprises a global positioning system (GPS) probe report, and wherein the probe sensor is selected from the group comprised of probe vehicles, commuters, and combinations thereof.

4. The method of claim 1 further comprising:

determining whether a speed is positive or negative.

5. The method of claim 1 further comprising:

determining whether the probe report emanated from a relevant transportation mode, wherein the relevant transportation mode is selected from the group comprised of cars, trucks, buses, and combinations thereof.

6. The method of claim 1 further comprising:

determining whether a probability of map matching the probe report is greater than or equal to a predefined threshold.

7. The method of claim 1 further comprising map matching the probe report based on distance and heading if the speed is greater than or equal to a predefined threshold.

8. The method of claim 1 further comprising map matching the probe report based on distance without heading if the speed is less than or equal to a predefined threshold.

9. The method of claim 1 further comprising:

determining whether a time difference between consecutive probe reports from the probe sensor exceeds a predefined frequency submission.

10. An apparatus comprising:

at least one processor; and at least one memory including computer program code for one or more programs, the at least one memory and the computer program code configured to, with the at least one processor, cause the apparatus to perform at least the following:

receive a probe report from a probe sensor, wherein the probe report comprises data indicative of a travel condition;

determine whether the probe report emanated from a location within a predefined boundary;

determine whether the probe report emanated from a relevant transportation mode, wherein the relevant transportation mode is a car, truck, or bus;

determine whether a time difference between consecutive probe reports from the probe sensor exceeds a predefined frequency submission; and identify the probe report as being suitable for use in modeling the travel condition if the probe report emanated a location within a predefined boundary, the probe report emanated from a relevant transportation mode, and a time difference between consecutive probe reports exceeds the predefined frequency submission.

11. The apparatus of claim 10 wherein the at least one memory and the computer program code are further configured to, with the at least one processor, cause the apparatus to perform at least the following:

receive a plurality of probe reports from one or a plurality of probe sources; and identify whether two or more of the plurality of probe are suitable for use in modeling the travel condition if the probe report.

12. The apparatus of claim 10 wherein the probe report comprises a global positioning system (GPS) probe report, and wherein the probe sensor is a probe vehicle or commuter.

13. The apparatus of claim 10, wherein the criterion is indicative of whether the probe report emanated from within a predefined boundary associated with a parking lot, a loading zone, a point of interest, or a combination thereof.

14. In a non-transitory computer-readable storage medium having stored therein data representing instructions executable by a programmed processor, the storage medium comprising instructions for:

receiving a probe report from a probe sensor, wherein the probe report comprises data indicative of a travel condition;

determining a probability of map matching the probe report;

identifying the probe report as being suitable for use in modeling the travel condition if the probe report the probability of map matching is greater than or equal to a predefined threshold; and outputting the probe report for modeling in response to the probe report being suitable for use in modeling the travel condition.

15. The non-transitory computer-readable storage medium of claim 14, wherein the storage medium further comprises instructions for:

determining, by the processor, whether the probe report satisfies a plurality of criteria selected from the group comprised of determining whether the probe report emanated from a location within a predefined boundary; determining whether a speed is positive or negative; determining whether a speed is less than or equal to a predefined threshold; determining whether the probe report emanated from within a predefined boundary associated with a parking lot, a loading zone, a point of interest, or a combination thereof; determining whether the probe report emanated from a relevant transportation mode, wherein the relevant transportation mode is selected from the group comprised of cars, trucks, buses, and combinations thereof; determining whether a time difference between consecutive probe reports from the probe sensor exceeds a predefined frequency submission; and combinations thereof; wherein the probe report is suitable for use in modeling the travel condition if the probe report satisfies the criterion.

16. The non-transitory computer-readable storage medium of claim 14, wherein the probability of map matching is based a distance of the probe report from the road and a heading of the probe report if a probe report speed is greater than a predefined speed threshold.

17. The non-transitory computer-readable storage medium of claim 14, wherein the probability of map matching is based a distance of the probe report from the road if a probe report speed is less than a predefined speed threshold.

18. The non-transitory computer-readable storage medium of claim 14, further comprising determining whether a time difference between consecutive probe reports from the probe sensor exceeds a predefined frequency submission.

19. The non-transitory computer-readable storage medium of claim 14, further comprising determining whether or not a heading contained in the probe report is compatible with a road direction.

* * * * *